United States Patent [19]

Hallock et al.

[11] Patent Number: 4,533,075

[45] Date of Patent: Aug. 6, 1985

[54] FASTENER SETTING TOOLS

[75] Inventors: Donald W. Hallock; Thomas M. Hartmann, both of Waupun; Marvin Engebretson, Ripon, all of Wis.

[73] Assignee: National Rivet & Manufacturing Company, Waupun, Wis.

[21] Appl. No.: 489,481

[22] Filed: Apr. 28, 1983

[51] Int. Cl.[3] ..... B21J 15/04; B21J 15/30; B21J 15/10

[52] U.S. Cl. ..... 227/55; 72/391; 72/393; 24/275; 227/53

[58] Field of Search ..... 29/243.53, 243.56, 275, 29/280; 72/114, 391, 393, 465, 453.17, 453.19; 227/51, 52, 53, 54, 55

[56] References Cited

U.S. PATENT DOCUMENTS

| | | | |
|---|---|---|---|
| 1,049,173 | 12/1912 | Turek | 29/275 X |
| 1,124,568 | 1/1915 | Wiedelce | 72/393 |
| 2,641,379 | 6/1953 | Barbaro | 29/275 X |
| 3,009,598 | 11/1961 | Tibbetts | 72/391 |
| 3,042,244 | 7/1962 | Van Hecke | 72/391 |

FOREIGN PATENT DOCUMENTS

| | | | |
|---|---|---|---|
| 2902881 | 2/1979 | Fed. Rep. of Germany | 227/55 |
| 1203407 | 1/1960 | France | 227/55 |

*Primary Examiner*—Paul A. Bell
*Attorney, Agent, or Firm*—Wheeler Law Firm

[57] ABSTRACT

Setting tool for setting fasteners by driving a pin into an opening of each fastener, comprising a split collet having a central opening through which the pin is driven, the abutting faces of the collet segments being functionally convex and the leading ends of their exterior surfaces defining outwardly opposed jaws. An O-ring encircling the collet urges the following ends of the collet segments together, thereby urging the jaws apart. A fastener can be inserted over the jaws to locate it for being set by the pin. In the illustrated structure at least a portion of the central opening of the collet is smaller than the shaft of the setting pin, so when the pin is thrust through the collet it spreads the segments apart, thereby more tightly engaging the interior wall of the fastener.

8 Claims, 11 Drawing Figures

AIR SUPPLY

FASTENER SETTING TOOLS

TECHNICAL FIELD

The invention relates to an impulse setting tool for fasteners of the type set by driving a pin into them.

BACKGROUND ART

Tools for supporting and setting fasteners such as hollow-bodied rivets are well known. A fastener is slipped over the nose of the tool, positioned on a workpiece, and the tool is triggered to drive an internal pin of the tool into the hollow center of the fastener, thereby fastening it to the workpiece. The tool is typically pneumatically driven.

One problem with this arrangement is that the tool has a substantial recoil when triggered, which can dislocate the tool with respect to the fastener, preventing the fastener from being properly set. One typical tool must be held against the workpiece being fastened with a force of approximately 140 pounds (64 kg.) to successfully set the fastener. Also, if a fastener is located on the tool and the tool is accidentally triggered while pointed away from a workpiece, the fastener can become a dangerous projectile, causing unintended injury to nearby persons or objects. Still another problem is how to secure the fastener to the tool before and during setting without complicating the task of removing the gun from the set fastener.

SUMMARY OF THE INVENTION

The setting tool disclosed and claimed in this specification includes a setting pin, a collet for supporting a fastener while setting it, and drive means for propelling the setting pin through the collet and into the opening of a fastener carried on the collet. The collet is split longitudinally into segments which surround an interior passage. The portions of the exterior surface of the collet segments nearest the leading edge of the collet are outwardly opposed jaws. The jaws are biased apart by suitable spreader means while the collet is located within the setting hole of a fastener. Engaging the fastener with the collet in this fashion not only prevents the collet from recoiling from the fastener, but also prevents the fastener from being propelled at a substantial velocity in the event the fastener is not lodged in a workpiece when the tool is triggered.

In the preferred embodiment the spreading means is formed as follows. The facing surfaces of the collet segments are functionally convex, meaning simply that one will rock forward and back with respect to the other when they are held together. The following ends of the collet segments are urged together by a retaining spring, thereby urging the jaws located on the leading end of the collet outwardly. The collet jaws can be barbed, thereby making it easier to slip a fastener onto the collet than to remove a fastener from the collet.

As another feature of the preferred embodiment, at least a portion of the central passage of the collet near its leading end is smaller than the diameter of corresponding parts of the setting pin. When the pin passes through the collet to set a fastener the jaws are momentarily urged apart, thereby gripping the fastener more tightly. This additional gripping action occurs only during the instant the fastener is being set, and thus does not interfere with locating the fastener on the tool or removing the tool from the set fastener.

The extremities of travel of the setting pin are adjustable with respect to the collet in the preferred embodiment. The pin is located on the first section and the collet is located on the second section of a telescoping housing. The housing can be contracted to increase the penetration of the collet by the pin or expanded to decrease that penetration. The housing sections are preferably threaded together and provided with a setscrew to make the adjustment easy to change or to hold.

BRIEF DESCRIPTION OF DRAWINGS

FIG. 2 is an enlarged longitudinal section of the collet and O-rings shown in FIG. 1.

FIGS, 9, 10, and 11 are are fragmentary longitudinal sections showing how the tool sets a fastener in a workpiece.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

Figures 1, 3, 4, 5, 6, 7, 8:
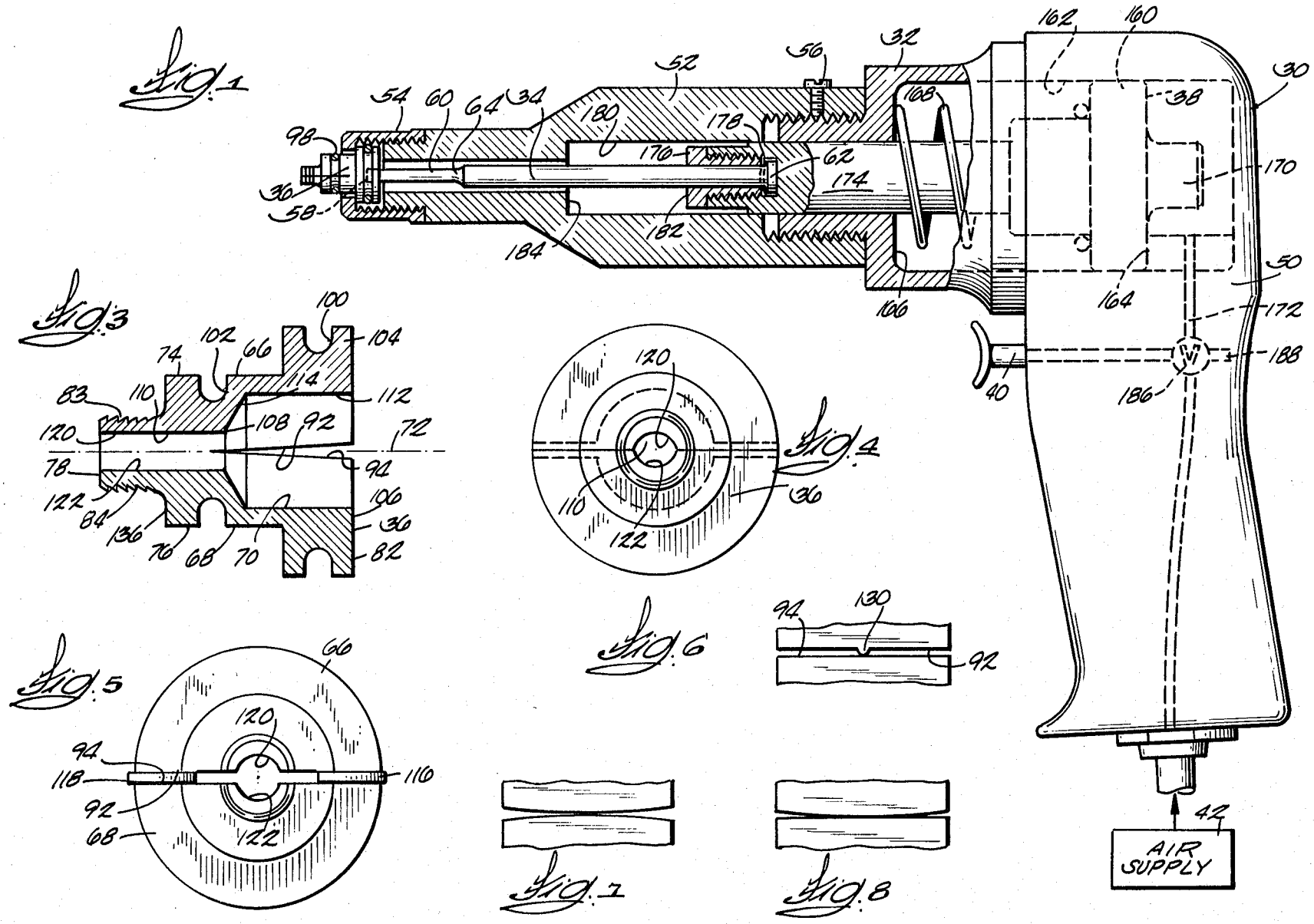
FIG. 1 is a side elevational view, partly in section, of a tool according to the present invention.
FIG. 3 is similar to FIG. 2, but shows the jaws at the forward end of the collet closed to their smallest spacing.
FIG. 4 is a front elevation of the structure shown in FIG. 3.
FIG. 5 is similar to FIG. 4, but shows the collet during a fabrication step.
FIGS. 6, 7, and 8 are fragmentary schematic views illustrating several pairs of surfaces which are functionally convex as defined herein.
Figure 12:
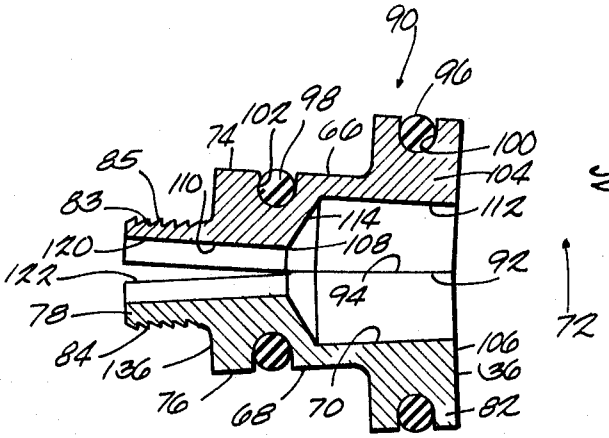
Figure 9:
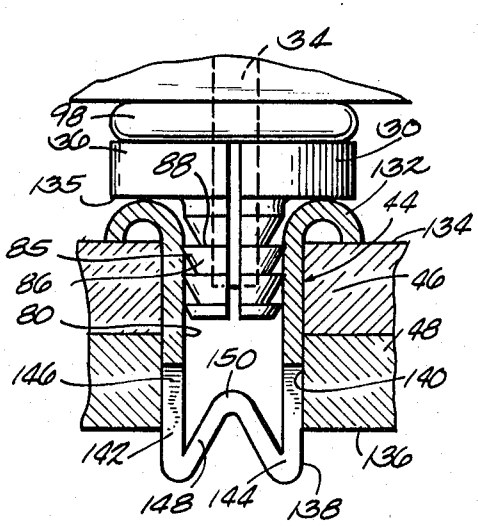

Referring first to FIGS. 1 and 9, tool 30 generally comprises a housing 32, a setting pin 34, a collet 36, and fluid drive means generally indicated at 38 operated by a trigger 40 for regulating flow from a source 42 of pressurized air or another operating fluid. Tool 30 is adapted to set a fastener 44 in workpieces such as 46 and 48.

Housing 32 comprises a handle section 50, a barrel section 52, and a retainer nut 54. Nut 54 and handle section 50 are threaded to the respective ends of barrel section 52 A setscrew 56 is threaded to barrel section 52 and bears on the threads of handle section 50, thereby permitting barrel section 52 to be advanced, retracted, or fixed with respect to handle section 50. The purpose for this adjustment will become evident from the description which follows.

Setting pin 34 has a leading end 58, a shaft 60 and in this embodiment a head 62 at its following end. The leading end of shaft 60 which interacts with collet 36 as explained below has a smaller diameter than the rest of the shaft.

Collet 36, shown in detail in FIGS. 2 and 9, comprises plural segments, here first and second segments 66 and 68 circumferentially enclosing an interior passage 70 disposed about the same longitudinal axis (72) as is setting pin 34. Segments 66 and 68 each have an exterior surface, respectively 74 and 76. Collet 36 has a leading end 78 for being received within a fastener interior wall 80 (defining the fastener's opening), and a following end 82 for being secured to barrel section 52 by retainer nut 54. The portions of exterior surfaces 74 and 76 adjacent leading end 78 are provided with outwardly opposed jaws 83 and 84 by machining sharp-edged ribs 85 in them. In the preferred and illustrated embodiment, the leading edge 86 of each rib 85 is ramped and the following edge 88 is not, providing circumferential barbs which allow a fastener 44 to be installed on jaws 83 and 84 more easily than the same fastener can be slipped off the jaws. Spreader means generally indicated at 90 normally bias jaws 83 and 84 apart into gripping contact with the interior wall 80 of a fastener, as shown in FIG. 9.

In this embodiment, spreader means 90 comprises functionally convex first and second facing surfaces 92 and 94, meeting substantially in a plane containing longitudinal axis 72, and retaining spring means, here elastomeric O-rings 96 and 98. The portions of facing surfaces 92 and 94 near following end 82 of collet 36 are relieved from their plane of intersection so their longitudinal cross-sections are V-shaped. This is one example of a functionally convex pair of surfaces.

The O-rings are respectively retained in a first circumferential groove 100 at the following end 82 of collet 36 and a second circumferential retaining groove 102 disposed between the leading and following ends 78 and 82 of collet 36. The respective retaining spring means thus encircle the exterior surfaces of the collet. The primary function of retaining spring 96 is to bias the respective following ends 104 and 106 of segments 66 and 68 together, thereby biasing jaws 83 and 84 apart. O-ring 98 assists in locating segments 66 and 68 and also controls the size of restricted opening 108 of passage 70. The structure just described will secure collet 36 and fastener 44 together before and during a fastening operation, thereby reducing the risk of throwing the fastener from the collet at high speed. Further structure in the illustrated embodiment materially assists in these functions.

Shaft 60 and passage 70 cooperate to urge jaws 83 and 84 into momentarily tighter engagement with the interior wall 80 of fastener 44 during the stroke of setting pin 34 through collet leading end 78. Passage 70 has a leading portion 110 extending from restricted opening 108 through leading end 78; a following portion 112 extending from the following end 82 of collet 36 forwardly; and a tapered central portion 114 communicating between portions 110 and 112. Portion 112 of passage 70 has a greater diameter than leading end 58 or the leading portion of shaft 60 of setting pin 34. As FIG. 1 illustrates, between setting strokes of setting pin 34 its leading end 58 is normally disposed within following portion 112. Leading portion 110 of passage 70, on the other hand, has at least one diameter, here the vertical diameter shown in FIG. 4, which is less than the diameter of the portion of shaft 60 it receives when a fastener is being set.

FIGS. 4 and 5 best illustrate the shape of leading portion 110. When facing surfaces 92 and 94 are parallel and separated by shims 116 and 118 of uniform thickness, the walls 120 and 122 of leading portion 110 lie on a cylinder having the same diameter as pin shaft 60. Shims 116 and 118 are removed before assembling the finished tool, and at least the portions of facing surfaces 92 and 94 adjacent restricted opening 108 abut. This brings walls 120 and 122 closer together, providing an eye-shaped restricted opening 108 which must yield to pass leading end 58 and shaft 60 of setting pin 34.

If jaws 83 and 84 are urged together so walls 120 and 122 abut along the entire length of leading portion 110, the collet will appear as in FIG. 3. However, in the illustrated embodiment O-ring 96 normally urges the portions of facing surfaces 92 and 94 surrounding following portion 112 of passage 70 into abutting relation, thereby spreading jaws 83 and 84 apart and causing leading portion 110 of passage 70 to open up from restricted opening 108 (which has essentially constant dimensions between setting strokes of pin 34) to leading end 78. As a consequence of the illustrated structure, when leading end 58 of pin 34 is driven forward to set a fastener, central portion 114 of passage 70 guides leading end 58 of pin 34 to center it on restricted opening 108, then opening 108 (and consequently jaws 83 and 84) is spread enough to allow shaft 60 to pass through. This spreading action is resisted somewhat by O-ring 98, but even more by the contact of jaws 83 and 84 with interior wall 80 of fastener 44.

Collet 36 can conveniently be fabricated as follows. first, exterior surfaces 74 and 76 and portions 112 and 114 of passage 70 are machined using conventional turning and boring tools. Next, segments 66 and 68 of the collet are separated by shims 116 and 118 as illustrated in FIG. 5 and walls 120 and 122 are machined to their final dimensions using a rotating tool. When shims 116 and 118 are removed as shown in FIG. 4, opening 108 and passage 110 will be eye-shaped, as illustrated, and the other surfaces of the collet will have rotational symmetry. The advantage of an eye-shaped leading portion 110 of passage 70, and particularly an eye-shaped restricted opening 108, is that the spreading force caused by the forward stroke of pin 34 will be directed primarily up and down to open jaws 83 and 84. As a final manufacturing step, the portions of facing surfaces 92 and 94 in the region of following portion 112 of opening 70 are relieved as described before, providing a functionally convex structure.

FIGS, 6, 7, and 8 are alternative configurations of facing surfaces 92 and 94, and bear the same reference characters as corresponding parts of FIG. 3. FIG. 6 illustrates a functionally convex pair of facing surfaces in which surface 92 is generally planar but includes a transverse bead 130 providing a bearing, while surface 94 is substantially planar.

FIG. 7 shows a structure in which the facing surfaces 92 and 94 are truly convex, as well as functionally convex. FIG. 8 shows a similar structure in which face 92 is curved and face 94 is flat, the two cooperating to form a functionally convex structure. Other functionally convex structures allowing faces 92 and 94 to rock forwardly and rearwardly with respect to each other can easily be devised and are within the scope of the invention.

Figure 10:
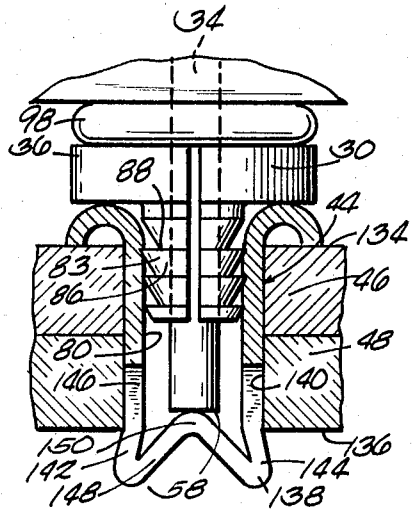
Figure 11:
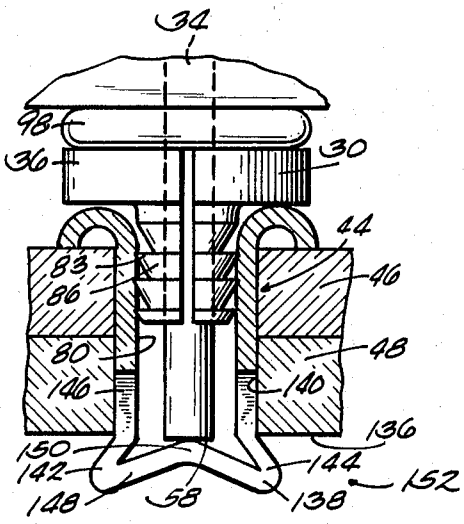

FIGS. 9, 10, and 11 are enlarged cross-sectional views illustrating how tool 30 sets a fastener 44 in workpieces such as 46 and 48. FIG. 9 shows the situation when a fastener 44 is temporarily secured to collet 36 by jaws 83 and 84, which open outward due to the inward bias provided by O-ring 96 (not shown in FIGS. 9–11). Using handle section 50 of housing 32, fastener 44 is positioned with its first or primary head 132 abutting surface 134 of workpiece 46, with surface 135 of collet 36 located against head 132. Fastener 44 is so sized and the distance between surface 134 of workpiece 46 and surface 136 of workpiece 48 is such that the leading end 138 of fastener 44 protrudes from opening 140 of workpiece 48. Leading end 138 has a generally W-shaped longitudinal section comprising folded legs such as 142 and 144, the outer portions 146 of which lie along a cylinder and the inner portions such as 148 of which form a cone, coming together at an apex 150. As FIGS. 1 and 9 illustrate, before fastener 44 is set leading end 58 of pin 34 is withdrawn into tool 30 and fastener 44 is loosely held by jaws 83 and 84. A shown in FIG. 10, when leading end 58 of pin 34 passes through collet 36 it spreads jaws 83 and 84 further apart, thus tightly gripping fastener 44. Leading end 58 then contacts apex 150, urging it forward as shown in FIGS. 10 and 11, thereby spreading legs 142 and 144 outward to form a second head 152 which is wider than opening 140 of workpiece 48. The shaft of fastener 44 is selected to substantially fill the aperture in which the fastener is set to provide a tight joint between the workpieces.

The structure for propelling settin pin 34 and limiting its forward and rearward travel is shown in FIG. 1. The impulse for driving setting pin 34 is provided by a pneumatic piston 160 carried within a cylinder 162. Piston 160 is confined to travel between abutments 164 and 166 of cylinder 162, and is normally held against abutment 164 by a return spring 168. A rear abutment 170 of piston 160 prevents piston 160 from blocking the path between pneumatic conduit 172 and the interior of cylinder 162. Piston 160 is secured to a ram 174 abutting head 62 of setting pin 34. Head 62 is maintained in contact with ram 174 by a retaining sleeve 176, which bears against a Belleville spring 178, which in turn bears against the outer margin of head 62. Retaining sleeve 176 also centers pin 34 within cylindrical passage 180 of barrel section 52.

When a fastener is to be set, valve 186 is operated by trigger 40 to allow communication between compressed air source 42 and conduit 172 communicating with the interior of cylinder 162. The resulting air pressure shifts piston 160 and pin 34 to the left to set a fastener. When trigger 40 is released, valve 186 shuts off communication with air supply 42 and allows communication between conduit 172 and vent 188, allowing return spring 168 to return piston 160 to its rest position.

We claim:

1. A setting tool for fasteners of the type set by driving a pin into an opening surrounded by an interior wall of said fastener, said tool comprising:

A. a setting pin disposed along an axis and having a leading end and shaft for being driven into the opening of a fastener;

B. a collet for supporting a fastener while it is being positioned and set, said collet including plural segments enclosing an interior passage disposed along said axis, exterior surfaces formed by said segments, a leading end for being received within a fastener opening, outwardly opposed barbed jaws formed in the least two of said exterior surfaces adjacent said collet leading end, and spreader means for normally biasing said jaws apart into gripping contact with the interior wall of a fastener; and c. drive means for propelling the leading end of said pin through the interior passage of said collet and axially engaging setting legs in the opening of a fastener carried on said collet, thereby setting said fastener; whereby the engagement between said jaws and a fastener prevents said tool from recoiling from said fastener while said fastener is being set.

2. The tool of claim 1, wherein said collet comprises first and second segments, respectively having first and second facing surfaces meeting substantially in a plane containing said axis.

3. The tool of claim 2, wherein said facing surfaces of functionally convex, said collet further includes a following end, and said facing surfaces are biased together at said following end, thereby biasing said jaws apart at said leading end.

4. The tool of claim 3, wherein said facing surfaces are biased together adjacent said following end by retaining spring means encircling the exterior surface of said collet.

5. The tool of claim 4, wherein said retaining spring means comprises an elastomeric O-ring.

6. The tool of claim 4, wherein a portion of said collet exterior surface between its leading and following ends is encircled by second retaining spring means.

7. The tool of claim 1, wherein at least a portion of the interior passage of said collet adjacent said collet leading end is normally slightly smaller than the corresponding part of said pin shaft, thereby causing said pin shaft to urge said jaws apart to more firmly engage a fastener carried on said jaws during a stroke of said pin shaft through said collet.

8. The tool of claim 1, further comprising first and second telescoping housing sections, wherein said collet is located with respect to said first housing section and said pin is located with respect to said second housing section, whereby to change the relative location of said collet and said pin leading end by telescoping said housing.

* * * * *